US011950689B2

(12) United States Patent
Cubrilovic et al.

(10) Patent No.: US 11,950,689 B2
(45) Date of Patent: Apr. 9, 2024

(54) EXPANDABLE DESK

(71) Applicant: Lenovo (Singapore) Pte. Ltd., New Tech Park (SG)

(72) Inventors: Kathryn Cubrilovic, Raleigh, NC (US); John Travis Wettroth, Chapel Hill, NC (US); Brian William Wallace, Wake Forest, NC (US); Samuel Patterson, Raleigh, NC (US); Yoshihito Nakagaki, Yokohama (JP)

(73) Assignee: Lenovo (Singapore) Pte. Ltd., New Tech Park (SG)

( * ) Notice: Subject to any disclaimer, the term of this patent is extended or adjusted under 35 U.S.C. 154(b) by 0 days.

(21) Appl. No.: 17/930,273

(22) Filed: Sep. 7, 2022

(65) Prior Publication Data

US 2024/0074575 A1 Mar. 7, 2024

(51) Int. Cl.
*A47B 1/05* (2006.01)

(52) U.S. Cl.
CPC ..... *A47B 1/05* (2013.01); *A47B 2200/0046* (2013.01)

(58) Field of Classification Search
CPC ..... A47B 1/04; A47B 1/03; A47B 2001/0053; A47B 2200/0046
See application file for complete search history.

(56) References Cited

U.S. PATENT DOCUMENTS

| | | | | |
|---|---|---|---|---|
| 1,473,323 | A * | 11/1923 | Schimmel | A47B 1/05 108/69 |
| 10,251,475 | B1 * | 4/2019 | Guffey | A47B 1/08 |
| 11,596,225 | B1 * | 3/2023 | Sherman | A47B 43/00 |
| 2017/0360188 | A1 * | 12/2017 | Alguire | A47B 9/00 |
| 2022/0368853 | A1 * | 11/2022 | Smith | G06F 3/016 |

FOREIGN PATENT DOCUMENTS

CN 108451164 A * 8/2018

OTHER PUBLICATIONS

English translation of CN 108451164 (Year: 2023).*

* cited by examiner

*Primary Examiner* — Daniel J Rohrhoff
(74) *Attorney, Agent, or Firm* — Kunzler Bean & Adamson

(57) ABSTRACT

Apparatuses, tables, and method of making the apparatuses and tables are disclosed for stowing and expanding a desk device. An exemplary apparatus, in one embodiment, includes a frame, a first surface slidably received by the frame in a horizontal plane between and including a stowed position and an expanded position, and a second surface slidably received by the frame between and including a stowed position and an expanded position.

15 Claims, 7 Drawing Sheets

EXPANDABLE DESK

FIELD

The subject matter disclosed herein relates to desks.

BACKGROUND

When working from home, condominium, or apartment, space is limited and office desks occupy a significant amount of space.

BRIEF SUMMARY

Apparatuses, tables, and method of making the apparatuses and tables are disclosed for stowing and expanding a desk device.

An apparatus, in one embodiment, includes a frame, a first surface slidably received by the frame in a horizontal plane between and including a stowed position and an expanded position, and a second surface slidably received by the frame between and including a stowed position and an expanded position.

A table, in one embodiment, includes legs, a frame supported by the legs, a first leaf slidably received by the frame in a horizontal plane between and including a stowed position and an expanded position, and a second leaf slidably received by the frame between and including a stowed position and an expanded position.

A method, in one embodiment, includes providing one or more motors configured to move the first and second leaves, providing a switch configured to provide control signals to the one or more motors, and providing a sensor configured to provide control signals to the one or more motors.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be limiting of scope, the embodiments will be described and explained with additional specificity and detail using the accompanying drawings, in which.

DETAILED DESCRIPTION

Figure 1:
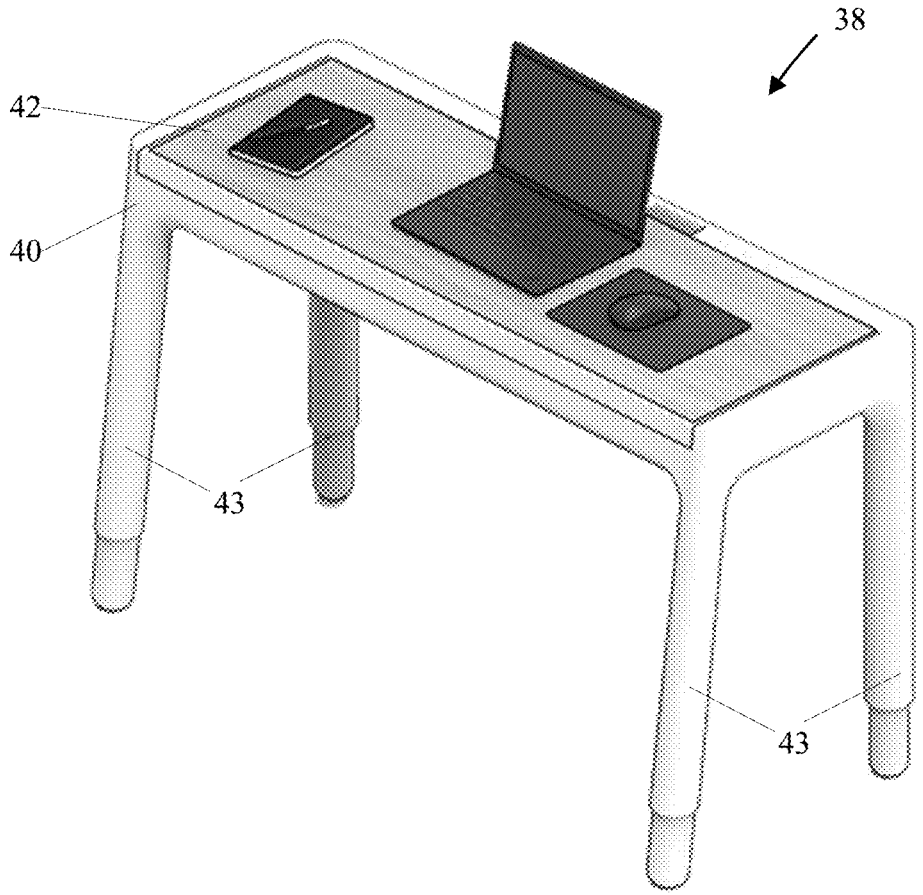
FIG. 1 is a perspective view of a table apparatus in a stowed configuration.

As will be appreciated by one skilled in the art, aspects of the embodiments may be embodied as a system, method, or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

Many of the functional units described in this specification have been labeled as modules, to emphasize their implementation independence more particularly. For example, a module may be implemented as a hardware circuit comprising custom very large scale integrated ("VLSI") circuits or gate arrays, off-the-shelf semiconductors such as logic chips, transistors, or other discrete components. A module may also be implemented in programmable hardware devices such as a field programmable gate array ("FPGA"), programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules and may be embodied in any suitable form and organized within any suitable type of data structure. The operational data may be collected as a single data set or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random-access memory (RAM), a read-only memory (ROM), an electrically erasable programmable read-only memory (EEPROM or Flash memory), a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Code for carrying out operations for embodiments may be written in any combination of one or more programming languages including an object-oriented programming language such as Python, Ruby, R, Java, Java Script, Smalltalk, C++, C sharp, Lisp, Clojure, PHP, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Surface Provider).

The embodiments may transmit data between electronic devices. The embodiments may further convert the data from a first format to a second format, including converting the data from a non-standard format to a standard format and/or converting the data from the standard format to a non-standard format. The embodiments may modify, update, and/or process the data. The embodiments may store the received, converted, modified, updated, and/or processed data. The embodiments may provide remote access to the data including the updated data. The embodiments may make the data and/or updated data available in real time. The embodiments may generate and transmit a message based on the data and/or updated data in real time. The embodiments may securely communicate encrypted data. The embodiments may organize data for efficient validation. In addition, the embodiments may validate the data in response to an action and/or a lack of an action.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise. The term "and/or" indicates embodiments of one or more of the listed elements, with "A and/or B" indicating embodiments of element A alone, element B alone, or elements A and B taken together.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. This code may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus, or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the figures illustrate the architecture, functionality, and operation of possible implementations of apparatuses, systems, methods, and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and code.

The apparatuses, tables, and methods of making the apparatuses and tables and their respective embodiments disclosed herein allow for expansion and/or contraction of a horizontally expandable surface. The description of elements in each figure may refer to elements of proceeding figures. Like numbers refer to like elements in all figures, including alternate embodiments of like elements.

Figure 2:
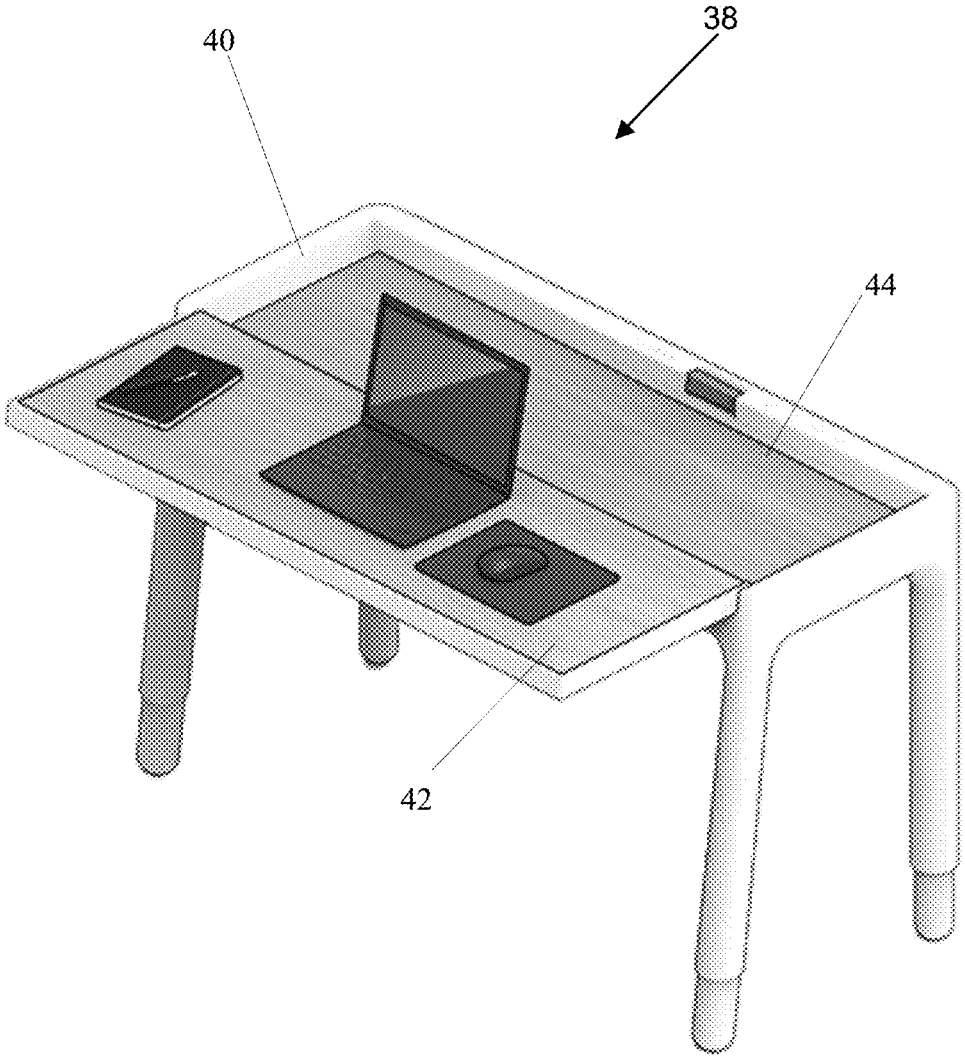
FIG. 2 is a perspective view of the table apparatus of FIG. 1 in a transition configuration.
Figure 3:
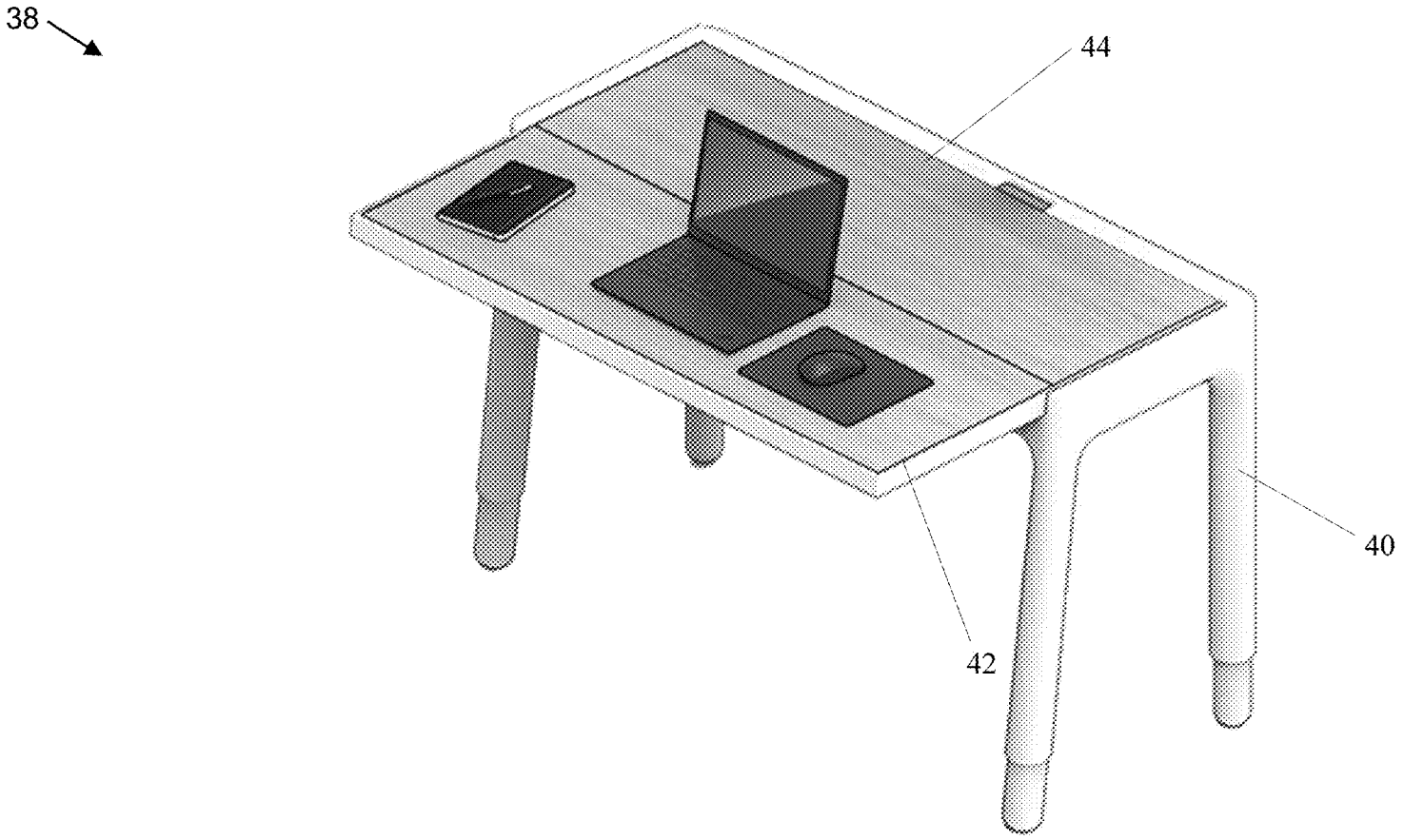
FIG. 3 is a perspective view of the table apparatus of FIG. 1 in an expanded configuration.
Figure 4:
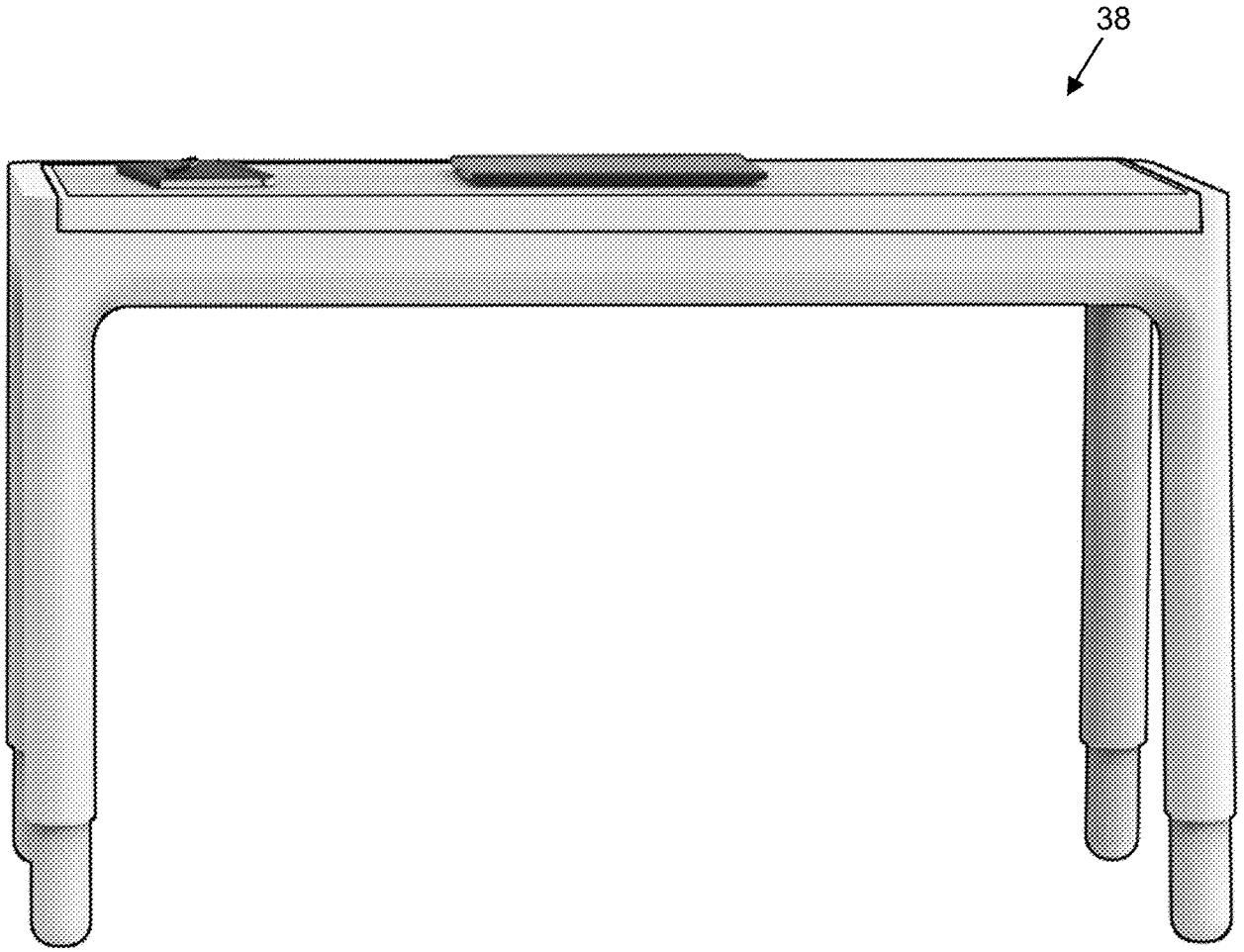
FIG. 4 is a front view of the table apparatus of FIG. 1 in the stowed configuration.

In various embodiments, referring to FIGS. 1-4, a table 38 includes a frame 40 having a top section supported by legs 43, a first leaf 42, and a second leaf 44. In a contracted position, as shown in FIG. 1, the first leaf 42 is positioned over the second leaf 44. In order to expand the table 38, the first leaf 42 slides within the top section of the frame 40 towards a sitting side of the table 38 until the first leaf 42 is no longer directly over the second leaf 44, as shown in FIG. 2. After the first leaf 42 has been moved, the second leaf 44 is raised within the top section of the frame 40, such that a top surface of the second leaf 44 is flush with a top surface of the first leaf 42 as shown in FIG. 3. The first and second leaves 42, 44 may be manually moved into the positions or may be moved into those position by a motor(s)/actuator(s) and associated mechanical components.

Figure 5:
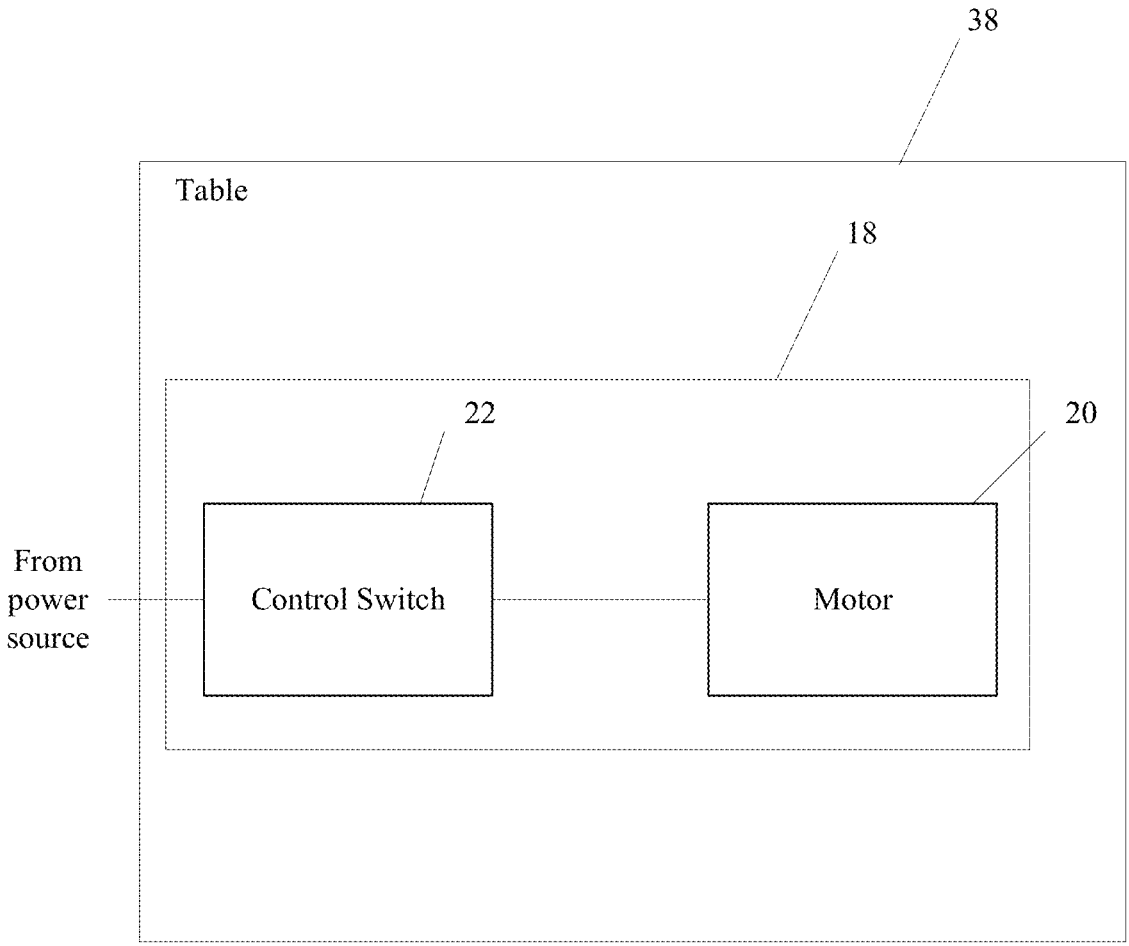
FIG. 5 is a block diagram of a table control apparatus.

Referring to FIG. 5, in various embodiments, a table surface control system 18 is incorporated in the table 38. The table surface control system 18 includes a motor(s)/actuator (s) 20 and a control switch 22 that receives power from a power source (e.g., external AC source or internal DC source). The motor(s)/actuator(s) 20 controls motion of the leaves (i.e., surface(s)) 42, 44 when the control switch 22 is activated by a user. The control switch 22 allows a user to control the motor(s)/actuator(s) 20 to perform an expanding operation and/or a contracting operation of the table 38.

Figure 6:
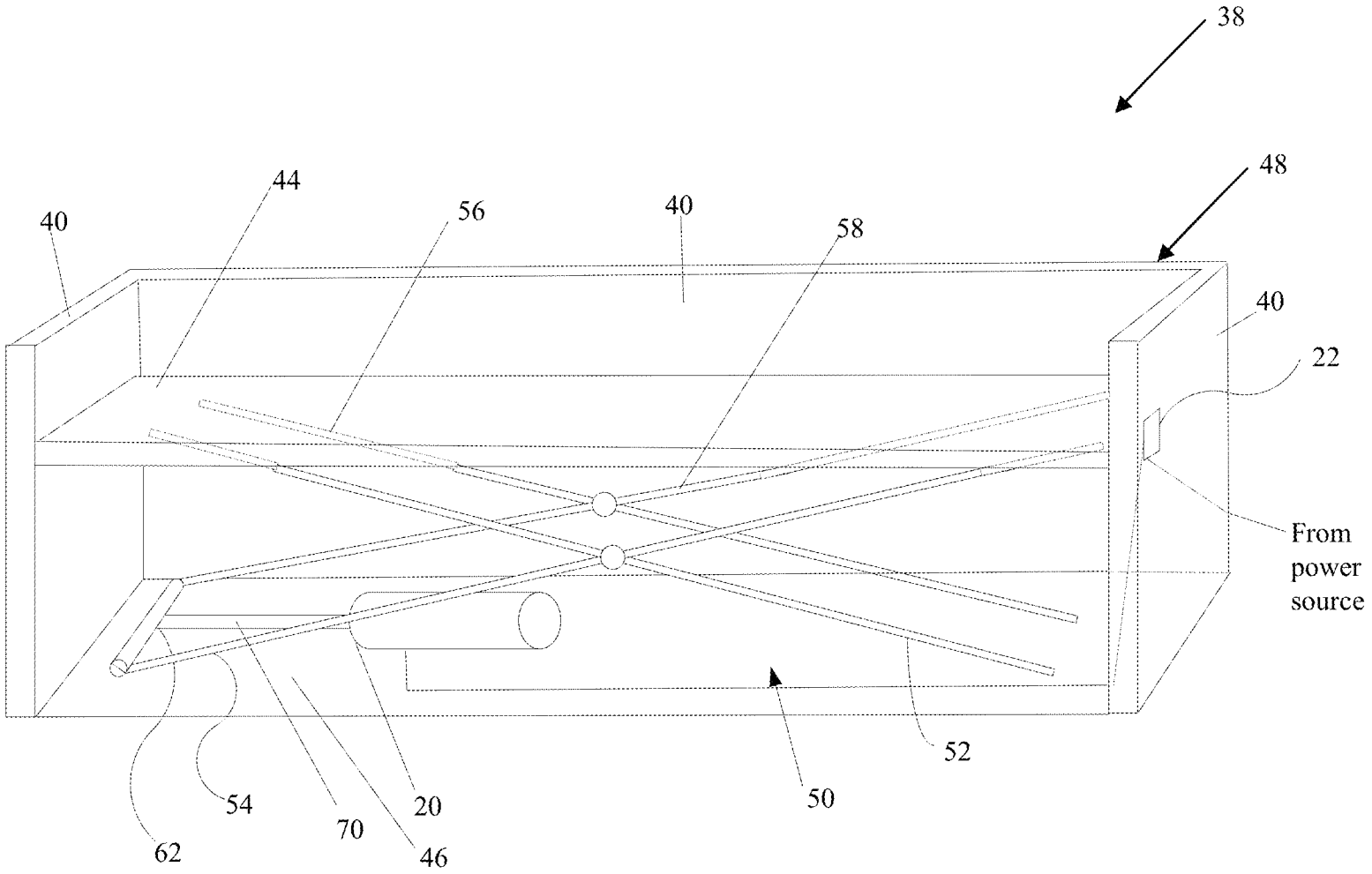
FIG. 6 is a perspective view of a lift mechanism for a table.

In various embodiments, referring to FIG. 6, a top section 48 of the table 38 includes the second leaf 44 mounted within the frame 40 and supported vertically by an adjustable scissors frame mechanism 50. The adjustable scissors frame mechanism 50 includes a first cross beam support having a first beam 52 rotatably mounted to an underside of the second leaf 44 and to a base 46 of the top section 48 and a second beam 54 having a first end rotatably mounted to the bottom surface of the second leaf 44 and a second end mounted to a bar 62. The adjustable scissors frame mechanism 50 includes a second cross beam having a third beam 56 rotatably mounted to the underside of the second leaf 44 and to the base 46 of the top section 48 and a fourth beam 58 having a first end rotatably mounted to the bottom surface of the second leaf 44 and a second end mounted to the bar 62. The bar 62 is slidable on the base 46 of the top section 48 and may be received within a track located thereon. A motor/actuator 20A is mounted to the base 46. The motor/actuator 20A includes an arm 70 attached to the bar 62. The motor/actuator 20A moves the arm 70 horizontally based on a control signal from the switch 22. Retraction of the arm 70 causes the adjustable scissors frame mechanism 50 to push the second leaf 44 vertically up. Extension of the arm 70 causes the adjustable scissors frame mechanism 50 to descend vertically. It can be appreciated by one of ordinary skill in the other types of motors and mechanical configurations may be used for causing vertical motion of the second leaf 44.

In various embodiments, the switch 22 may include a sensor or toggle that senses or flips when the first leaf 42 moves to a position that would no longer block motion of the second leaf 44. Thus, the switch 22 and/or the motor/actuator associated with the second leaf 44 is deactivated until movement of the second leaf 44 would not be impeded by the first leaf 42.

Figure 7:
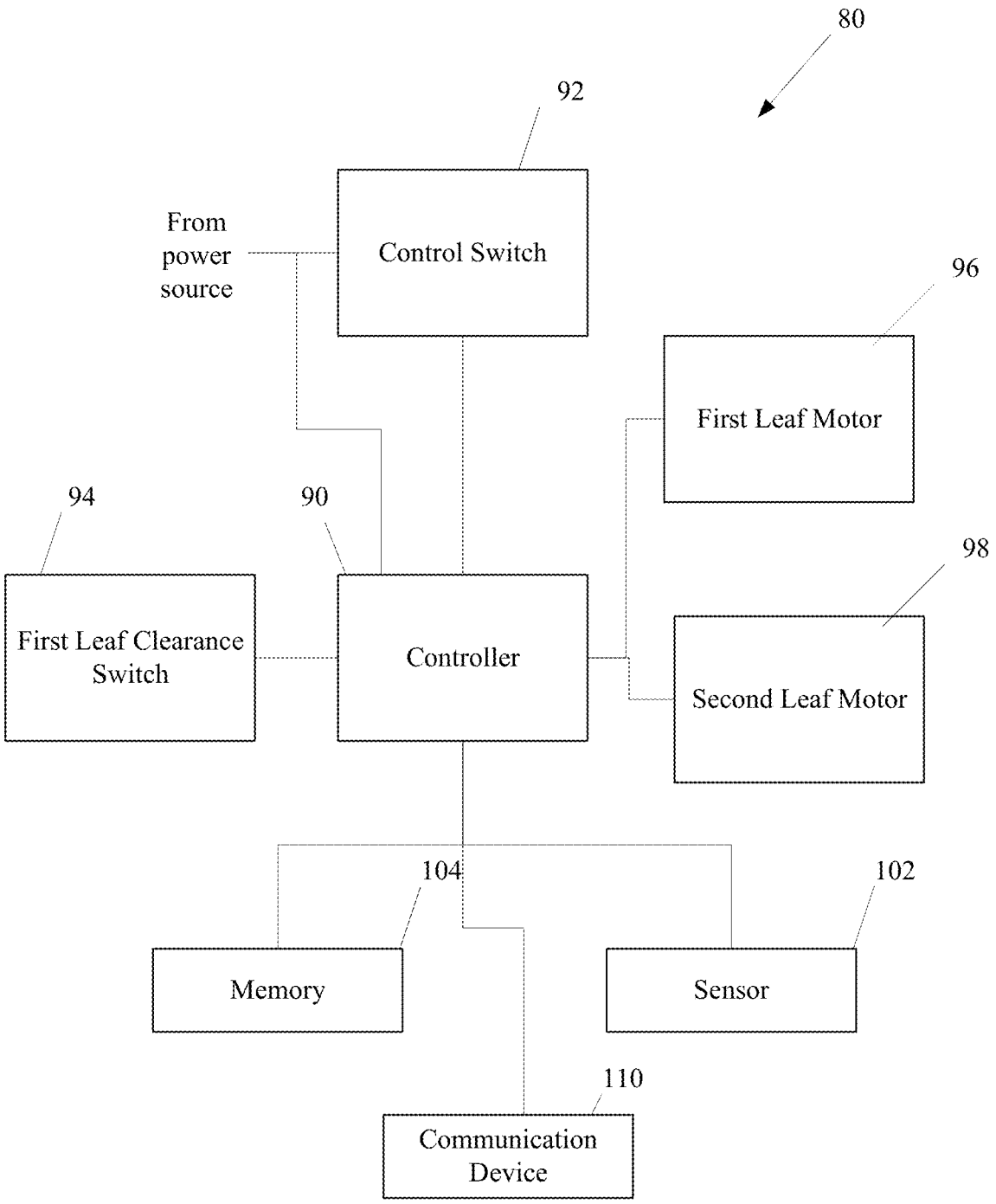
FIG. 7 is a block diagram of an alternate table control apparatus.

In an alternative embodiment, referring to FIG. 7, a table surface control system 80 includes a controller 90, a control switch 92, a first leaf clearance sensor 94, a first leaf motor 96, and a second leaf motor 98. The control switch 92 is a user operable switch that allows a user to send a close or open instruction to the controller 90. In response to the close or open instruction, the controller 90 controls operation of the first leaf motor 96 and the second leaf motor 98. When an opening operation is being performed, the controller 90 instructs the first leaf motor 96 to slide the first leaf (42, FIG. 1) to an open position. Then, once the first leaf clearance switch 94 indicates that the first leaf is in its open position or has moved enough to allow the second leaf (44, FIG. 1) to move from its closed position to its open position, the controller 90 instructs the second leaf motor 98 to raise the second leaf to an open position.

In various embodiments, the table surface control system 80 may further include a sensor 102, a memory 104, and a communication device 110. The memory 104 includes non-transitory computer-readable instructions configured to cause the controller 90 to perform predefined operations, as will be described below. The sensor 102 and to provide information associated with the change in an environmental or situational condition. The change information from the sensor 102 is provided to the controller 90. The controller 90 may perform a closer open operation responsive to the received change information in accordance with the instructions stored in the memory 104. For example, without limitation, the sensor 102 may be a weight or object sensor (camera, etc.) that identifies when a number of devices located on the first leaf is greater than a threshold value or when a laptop has been removed from the first leaf. The sensor 102 may be a proximity or a motion sensor that determines that no user has been present within the vicinity of the associated table for a threshold period of time or the second leaf is not supporting any devices or not supporting any devices that are greater than a threshold height.

When the associated table is in the closed configuration, there may be a gap present between a top of the second leaf and a bottom of the first leaf, thus allowing certain items, such as, without limitation, a mouse, a keyboard, or a close laptop computer, to remain on the second leaf. In various embodiments, the stored instructions may instruct the controller 90 to perform close or open operations responsive to a time of day that may coincide with a beginning or an end of a workday, a beginning or an end of an office cleaning operation, or comparable calendared events.

In various embodiments, the stored instructions may instruct the controller 90 to perform closer open operations responsive to a signal sent by an external source, such as a remote-control device or a remotely located device, via the communication device 110. The communication device 110 may communicate with the remotely located device via a wired or wireless connection to the remotely located device via a network.

Motors and actuators (linear or rotational) are well known in the art and no further explanation is necessary for a person of skill in the art to understand disclosed subject matter.

EMBODIMENTS

A. An apparatus comprising a frame, a first surface slidably received by the frame in a horizontal plane between and including a stowed position and an expanded position, and a second surface slidably received by the frame between and including a stowed position and an expanded position.

B. The apparatus of A, wherein the second surface is positioned under the first surface in the stowed position.

C. The apparatus of B, wherein the second surface is in a vertical position matching a vertical position of the first surface in the expanded position.

D. The apparatus of any of A-C, further comprising a device configured to block the second surface from moving in a vertical direction until the first surface is at a predefined location relative to the frame.

E. The apparatus of any of A-D, further comprising a first motor configured to move the second surface in a vertical direction.

F. The apparatus of E, wherein the device is further configured to deactivate the first motor from moving the second surface, when the first surface is blocking the second surface.

G. The apparatus of claim F, further comprising a switch configured to cause: the first motor to move the second surface vertically upward to the expanded position responsive to the switch being in a first position; and the first motor to move the second surface vertically downward to the stowed position responsive to the switch being in a second position.

H. The apparatus of F or G, further comprising a sensor configured to: sense a first condition; generate a first signal responsive to sensing the first condition; and send the first signal to the motor. The first signal is configured to cause the first motor to move the second surface vertically upward to the expanded position or vertically downward to the stowed position.

I. The apparatus of H, further comprising a second motor configured to move the first surface horizontally responsive to the first signal, the switch being in the first position, or the switch being in the second position.

J. A table comprising legs, a frame supported by the legs, a first leaf slidably received by the frame in a horizontal plane between and including a stowed position and an expanded position, and a second leaf slidably received by the frame between and including a stowed position and an expanded position.

K. The table of J, wherein the second leaf is positioned under the first leaf in the stowed position.

L. The table of any of J or K, wherein the second leaf is in a vertical position matching a vertical position of the first leaf in the expanded position.

M. The table of any of J-L, further comprising a device configured to block the second leaf from moving in a vertical direction until the first leaf is at a predefined location relative to the frame.

N. The table of M, further comprising a first motor configured to move the second leaf in a vertical direction.

O. The table of M or N, wherein the device is further configured to deactivate the first motor from moving the second leaf, when the first leaf is blocking the second leaf.

P. The table of any of M-O, further comprising a switch configured to cause: the first motor to move the second leaf vertically upward to the expanded position responsive to the switch being in a first position; and the first motor to move the second leaf vertically downward to the stowed position responsive to the switch being in a second position.

Q. The table of P, further comprising a sensor configured to: sense a first condition; generate a first signal responsive to sensing the first condition; and send the first signal to the motor. The first signal is configured to cause the first motor to move the second leaf vertically upward to the expanded position or vertically downward to the stowed position.

R. The table of Q, further comprising a second motor configured to move the first leaf horizontally responsive to the first signal, the switch being in the first position, or the switch being in the second position.

S. A method of making a stowable table, the method comprising providing a table frame; slidably receiving a first leaf horizontally within the table frame; and slidably receiving a second leaf vertically within the table frame. The first leaf is located above the second leaf when the stowable table is in a stowed condition and the first leaf and the second leaf are horizontally aligned when the stowable table is in an expanded condition.

T. The method of S, further comprising providing one or more motors configured to move the first and second leaves; providing a switch configured to provide control signals to the one or more motors; and providing a sensor configured to provide control signals to the one or more motors.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a frame;

a first surface slidably received by the frame in a horizontal plane between and including a stowed position and an expanded position;

a second surface slidably received by the frame between and including a stowed position and an expanded position;

a first motor configured to move the second surface in a vertical direction; and a switch configured to cause:

the first motor to move the second surface vertically upward to the expanded position responsive to the switch being in a first position; and the first motor to move the second surface vertically downward to the stowed position responsive to the switch being in a second position.

2. The apparatus of claim 1, wherein the second surface is positioned under the first surface in the stowed position.

3. The apparatus of claim 2, wherein the second surface is in a vertical position matching a vertical position of the first surface in the expanded position.

4. The apparatus of claim 1, further comprising a device configured to block the second surface from moving in a vertical direction until the first surface is at a predefined location relative to the frame.

5. The apparatus of claim 1, wherein the device is further configured to deactivate the first motor from moving the second surface, when the first surface is blocking the second surface.

6. The apparatus of claim 1, further comprising a sensor configured to:

sense a first condition;

generate a first signal responsive to sensing the first condition; and send the first signal to the first motor, wherein the first signal is configured to cause the first motor to move the second surface vertically upward to the expanded position or vertically downward to the stowed position.

7. The apparatus of claim 6, further comprising a second motor configured to move the first surface horizontally responsive to the first signal, the switch being in the first position, or the switch being in the second position.

8. A table comprising:

legs;

a frame supported by the legs;

a first leaf slidably received by the frame in a horizontal plane between and including a stowed position and an expanded position;

a second leaf slidably received by the frame between and including a stowed position and an expanded position;

a first motor configured to move the second leaf in a vertical direction; and a switch configured to cause:

the first motor to move the second leaf vertically upward to the expanded position responsive to the switch being in a first position; and the first motor to move the second leaf vertically downward to the stowed position responsive to the switch being in a second position.

9. The table of claim 8, wherein the second leaf is positioned under the first leaf in the stowed position.

10. The table of claim 9, wherein the second leaf is in a vertical position matching a vertical position of the first leaf in the expanded position.

11. The table of claim 8, further comprising a device configured to block the second leaf from moving in a vertical direction until the first leaf is at a predefined location relative to the frame.

12. The table of claim 8, wherein the device is further configured to deactivate the first motor from moving the second leaf, when the first leaf is blocking the second leaf.

13. The table of claim 8, further comprising a sensor configured to:

sense a first condition;

generate a first signal responsive to sensing the first condition; and send the first signal to the first motor, wherein the first signal is configured to cause the first motor to move the second leaf vertically upward to the expanded position or vertically downward to the stowed position.

14. The table of claim 13, further comprising a second motor configured to move the first leaf horizontally responsive to the first signal, the switch being in the first position, or the switch being in the second position.

15. A method of making a stowable table, the method comprising:

providing a table frame;

slidably receiving a first leaf horizontally within the table frame;

slidably receiving a second leaf vertically within the table frame, wherein the first leaf is located above the second leaf when the stowable table is in a stowed condition, wherein the first leaf and the second leaf are horizontally aligned when the stowable table is in an expanded condition;

providing one or more motors configured to move the first leaf or the second leaf;

providing a switch configured to provide control signals to the one or more motors; and providing a sensor configured to provide control signals to the one or more motors.

* * * * *